US010170052B2

(12) United States Patent
Nam et al.

(10) Patent No.: US 10,170,052 B2
(45) Date of Patent: Jan. 1, 2019

(54) DISPLAY DEVICE

(71) Applicant: SAMSUNG DISPLAY CO., LTD., Yongin-si, Gyeonggi-do (KR)

(72) Inventors: Hui Nam, Yongin-si (KR); Myung-Ho Lee, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 169 days.

(21) Appl. No.: 15/089,010

(22) Filed: Apr. 1, 2016

(65) Prior Publication Data

US 2017/0061888 A1 Mar. 2, 2017

(30) Foreign Application Priority Data

Aug. 31, 2015 (KR) ..... 10-2015-0122669

(51) Int. Cl.
*G09G 3/3266* (2016.01)
*G09G 3/36* (2006.01)

(52) U.S. Cl.
CPC ..... *G09G 3/3266* (2013.01); *G09G 3/3674* (2013.01)

(58) Field of Classification Search
CPC ..... G09G 3/3266
See application file for complete search history.

(56) References Cited

U.S. PATENT DOCUMENTS 6,147,667 A * 11/2000 Yamazaki ..... G02F 1/13454 257/59
2006/0164367 A1* 7/2006 An ..... G09G 3/3648 345/98
2011/0298836 A1* 12/2011 Komiya ..... G09G 3/3233 345/690
2012/0194773 A1* 8/2012 Kim ..... G02F 1/13336 349/139
2013/0187131 A1* 7/2013 Chung ..... H01L 27/326 257/40
2013/0334543 A1* 12/2013 Kim ..... H01L 33/36 257/79
2014/0078123 A1* 3/2014 Park ..... G09G 3/20 345/205
2015/0084038 A1* 3/2015 Kang ..... G06K 9/0002 257/43
2015/0255040 A1* 9/2015 Inada ..... G09G 3/3611 345/690

(Continued)

FOREIGN PATENT DOCUMENTS

KR 10-2011-0114266 A 10/2011
KR 10-2012-0031367 A 4/2012
KR 10-2014-0037655 A 3/2014

*Primary Examiner* — Nelson Rosario
*Assistant Examiner* — Scott Au
(74) *Attorney, Agent, or Firm* — Lewis Roca Rothgerber Christie LLP

(57) ABSTRACT

A display device may include a plurality of pixels and a driving circuit. The plurality of pixels may respectively include a plurality of pixel circuits each having at least one transistor, and a plurality of display structures connected to the plurality of pixel circuits. The driving circuit may drive the plurality of pixels. The plurality of display structures may define a display region of the display device, and the driving circuit may be disposed at a center portion of the display region.

20 Claims, 9 Drawing Sheets

(56) References Cited

U.S. PATENT DOCUMENTS

2015/0310807 A1* 10/2015 Sun ..... G09G 3/3208
345/205
2016/0086533 A1* 3/2016 Song ..... H01L 51/0097
345/80

* cited by examiner

DISPLAY DEVICE

CROSS-REFERENCE TO RELATED APPLICATION

This application claims, under 35 USC § 119, priority to and the benefit of Korean Patent Application No. 10-2015-0122669, filed on Aug. 31, 2015 in the Korean Intellectual Property Office (KIPO), the entire disclosure of which is incorporated by reference herein.

BACKGROUND

1. Field

Aspects of embodiments of the present invention relate to display devices.

More particularly, example embodiments relate to display devices including driving circuits.

2. Related Art

A display device may include a plurality of pixels arranged in a matrix structure. The plurality of pixels may be connected to a data driver through data lines to receive data signals, and may be connected to a scan driver through scan lines to receive scan signals. The plurality of pixels may display images based on the data signals and the scan signals.

In general, the scan driver may be disposed in a non-display region surrounding a display region that is defined by the plurality of pixels. Because of the scan driver disposed in the non-display region, a size of the non-display region may increase, and thus a dead space of the display device may increase.

Recently, a size of the display device has increased, and a resolution of the display device has increased. As a result, lengths of the scan lines for connecting the scan driver to the plurality of pixels may increase, so that charging and discharging time for the scan lines may increase.

SUMMARY

Example embodiments provide a display device having a driving circuit disposed at a center portion or central portion of a display region.

Example embodiments provide a display device having a first driving circuit and a second driving circuit disposed at a center portion or central portion of a display region.

According to one embodiment of the present invention, a display device includes a plurality of pixels respectively including a plurality of pixel circuits, each of the pixel circuits having at least one transistor, and a plurality of display structures connected to the plurality of pixel circuits, the plurality of display structures defining a display region of the display device; and a driving circuit configured to drive the plurality of pixels, the driving circuit being at a center portion of the display region.

Each of the plurality of pixel circuits may be connected to a corresponding display structure among the plurality of display structures, and may not overlap the corresponding display structure.

Each of the plurality of pixel circuits may be spaced apart by a distance from the corresponding display structure.

The plurality of pixel circuits and the driving circuit may be disposed at a same level.

A width of each of the plurality of pixel circuits may be the same as a width of each of the plurality of display structures.

At least one of the plurality of pixel circuits may be at least partially outside the display region.

A width of each of the plurality of pixel circuits may be narrower than a width of each of the plurality of display structures.

A sum of widths of the plurality of pixel circuits and a width of the driving circuit may be less than or equal to a sum of widths of the plurality of display structures.

The display structure may include an anode on the transistor and electrically connected to the transistor, an organic light-emitting layer on the anode, and a cathode on the organic light-emitting layer.

The display structure may include a pixel electrode on the transistor and electrically connected to the transistor, a liquid crystal layer on the pixel electrode, and a common electrode on the liquid crystal layer.

The driving circuit may include a scan driver configured to supply scan signals to the plurality of pixels.

The driving circuit may include a light-emitting control driver configured to supply light-emitting control signals to the plurality of pixels.

According to one embodiment of the present invention, a display device includes a plurality of pixels respectively including a plurality of pixel circuits, each of the pixel circuits having at least one transistor, and a plurality of display structures connected to the plurality of pixel circuits, the plurality of display structures defining a display region of the display device, the plurality of pixels including a first plurality of pixels is a first direction from a center-line of the display region; and a second plurality of pixels in a second direction from the center-line, the second direction being opposite to the first direction; a first driving circuit configured to drive the first plurality of pixels; and a second driving circuit configured to drive the second plurality of pixels, wherein the first driving circuit and the second driving circuit are at a center portion of the display that includes the center-line.

The first driving circuit and the second driving circuit may share a power supply line.

The first driving circuit is configured to receive first clock signal, and the second driving circuit is configured to receive a second clock signal. A frequency of the first clock signal may be different from a frequency of the second clock signal.

The display device may further include a first data driver connected to the first plurality of pixels, and a second data driver connected to the second plurality of pixels. The first data driver may be configured to receive the first clock signal, and the second data driver may be configured to receive the second clock signal.

In some example embodiments, the first driving circuit may be configured to receive a first clock signal, and the second driving circuit may be configured to receive a second clock signal. The second clock signal may periodically have an activation period in which the second clock signal periodically toggles and a deactivation period in which the second clock signal is deactivated. A frequency of the second clock signal in the activation period may be the same as a frequency of the first clock signal.

The display device may further include a data driver connected to the first plurality of pixels and the second plurality of pixels. The data drive may be configured to receive the first clock signal.

The first driving circuit may include a first scan driver configured to supply first scan signals to the first plurality of pixels, and the second driving circuit may include a second scan driver configured to supply second scan signals to the second plurality of pixels.

The first driving circuit may include a first light-emitting control driver configured to supply first light-emitting control signals to the first ones of the plurality of pixels, and the second driving circuit may include a second light-emitting control driver configured to supply second light-emitting control signals to the second ones of the plurality of pixels.

According to example embodiments, the display device may include the driving circuit disposed at the center portion or central portion of the display region, so that the size of the non-display region may be reduced (e.g., may decrease), and thus the dead space may be reduced (e.g., decreased). Moreover, each of the plurality of pixel circuits may be disposed not to overlap the corresponding display structure among the plurality of display structures, so that the images may be displayed on a whole area of the display region even through the driving circuit is disposed at the center portion or central portion of the display region.

According to some example embodiments, the display device may include the first driving circuit and the second driving circuit which are located at the center portion of the display region, and the first driving circuit and the second driving circuit may apply the driving signals that have different frequencies from each other to the first ones and the second ones of the plurality of pixels, respectively, so that the first ones of the plurality of pixels and the second ones of the plurality of pixels may be independently driven, and the display region may be divided in two regions for displaying two different images.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, display devices in accordance with example embodiments will be explained in detail with reference to the accompanying drawings.

Figure 1:
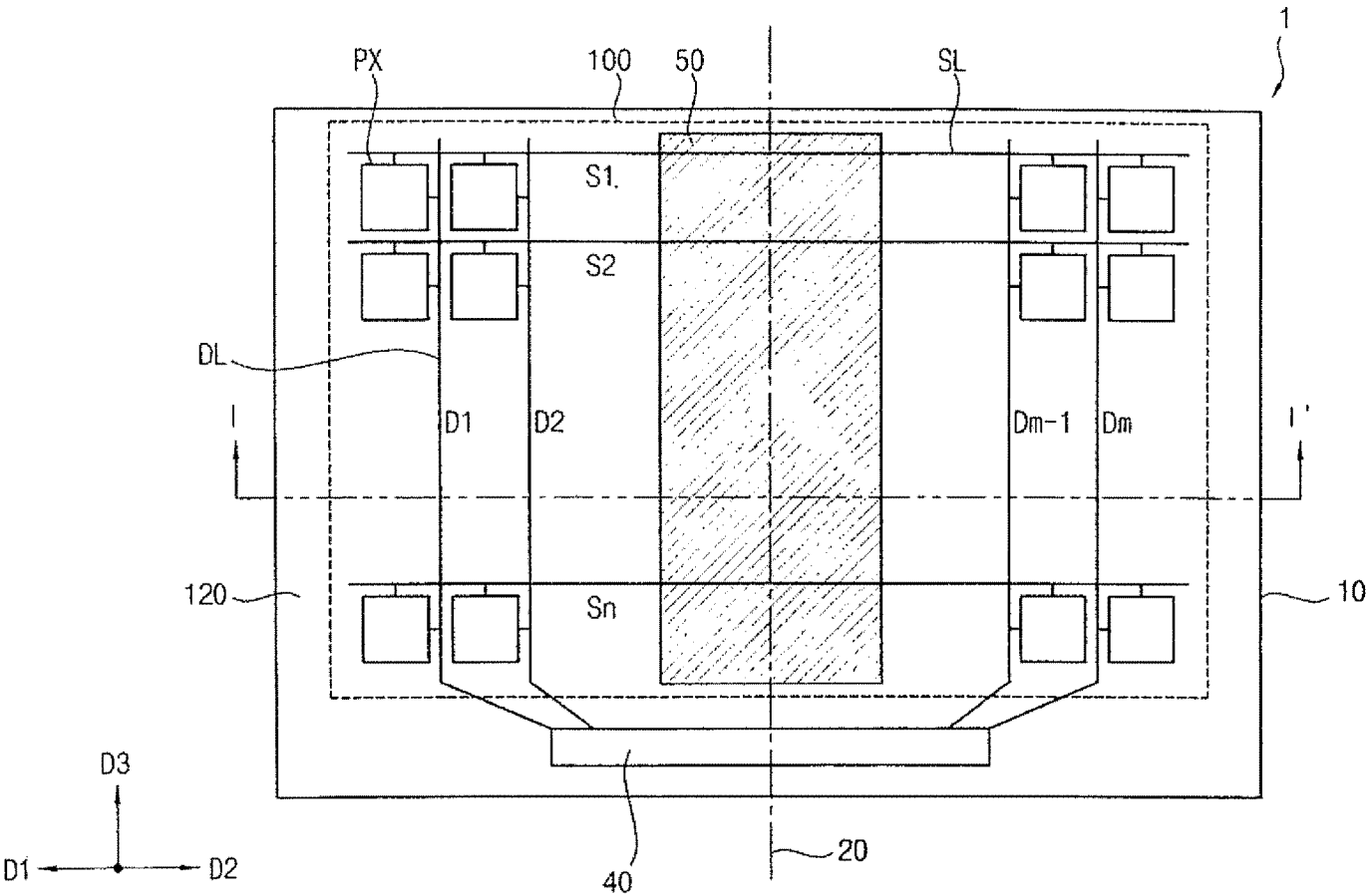
FIG. 1 is a plan view illustrating a display device in accordance with example embodiments of the present invention.

FIG. 1 is a plan view illustrating a display device in accordance with example embodiments of the present invention.

Referring to FIG. 1, a display device 1 may include a display panel 10, a plurality of pixels PX, a data driver 40 and a driving circuit 50.

The display panel 10 may include a display region 100 and a non-display region 120 surrounding the display region 100.

The display region 100 may be an area in which images are displayed. The display region 100 may be defined by a plurality of display structures 70, illustrated in FIG. 2, which are included in the plurality of pixels PX, respectively. In example embodiments of the present invention, the display region 100 may be disposed at a center of the display panel 10.

The non-display region 120 may be a peripheral area in which the images are not displayed. For example, the non-display region 120 may surround the display region 100 and disposed at an edge of the display panel 10.

A plurality of driving lines (e.g. scan lines) SL, a plurality of data lines DL, and the plurality of pixels PX may be disposed in the display region 100. The plurality of driving lines SL may extend in a first direction D1 and a second direction D2 opposite to the first direction D1, and may transfer driving signals (e.g. scan signals) S1 through Sn. The plurality of data lines DL may extend in a third direction D3 perpendicular to the first direction D1 (and perpendicular to the second direction D2), and may transfer data signals D1 through Dm (e.g., transfer to respective ones of the data lines DL). The plurality of pixels PX may be connected to the driving lines SL and the data lines DL.

The plurality of pixels PX may be arranged in the first direction D1 and the third direction D3 on the display panel 10 in a substantially matrix structure. For example, the plurality of pixels PX may be arranged in N rows and M columns which are perpendicular to each other, where the N and M are positive integers.

The data driver 40 may be connected to the data lines DL. The data driver 40 may generate and transfer the data signals D1 through Dm to the plurality of pixels PX. For example, as illustrated in FIG. 1, the data driver 40 may be mounted on the non-display region 120 of the display panel 10. However, the data driver 40 may be mounted on a flexible printed circuit to be connected to the display panel 10. The plurality of pixels PX may emit light based on the data signals D1 through Dm transferred from the data driver 40.

The driving circuit 50 may be connected to the driving lines SL. The driving circuit 50 may generate and transfer the driving signals S1 through Sn to the plurality of pixels PX. Transistors included in the plurality of pixels PX may be switched based on the driving signals S1 through Sn transferred from the driving circuit 50.

The driving circuit 50 may be disposed at a center portion (or central portion) of the display region 100. For example, the center portion of the display region 100 may be located at the middle of the display region 100 in the first direction D1, and may extend in the third direction D3. (For example, at least a portion of the driving circuit 50 is disposed between the first driving line configured supplied with the first driving signal S1 and the last driving line supplied with the last driving signal Sn along the third direction D3 and between the first data line supplied with data signal D1 and the last data line supplied with data signal Dm along the first and second directions D1 and D2.) A center-line 20 may pass through the center of the display panel 10 and may extend along the third direction D3, and the driving circuit 50 may be disposed on the center-line 20 (e.g., at least a portion of the driving circuit 50 may overlap the center-line 20 or substantially equal portions of the driving circuit 50 are located on either side of the center-line 20). The driving circuit 50 may include a plurality of transistors.

In example embodiments, the driving circuit 50 may include a scan driver that applies scan signals to the plurality of pixels PX. Here, the driving lines SL that correspond to scan lines may extend from the driving circuit 50 in the first direction D1 and the second direction D2, and may be connected to a switching transistor included in each of the plurality of pixels PX.

In some example embodiments, the driving circuit 50 may include a light-emitting control driver that applies light-emitting control signals to the plurality of pixels PX. Here, the driving lines SL that correspond to light-emitting control lines may extend from the driving circuit 50 in the first direction D1 and the second direction D2, and may be connected to a light-emitting control transistor included in each of the plurality of pixels PX.

Figure 2:
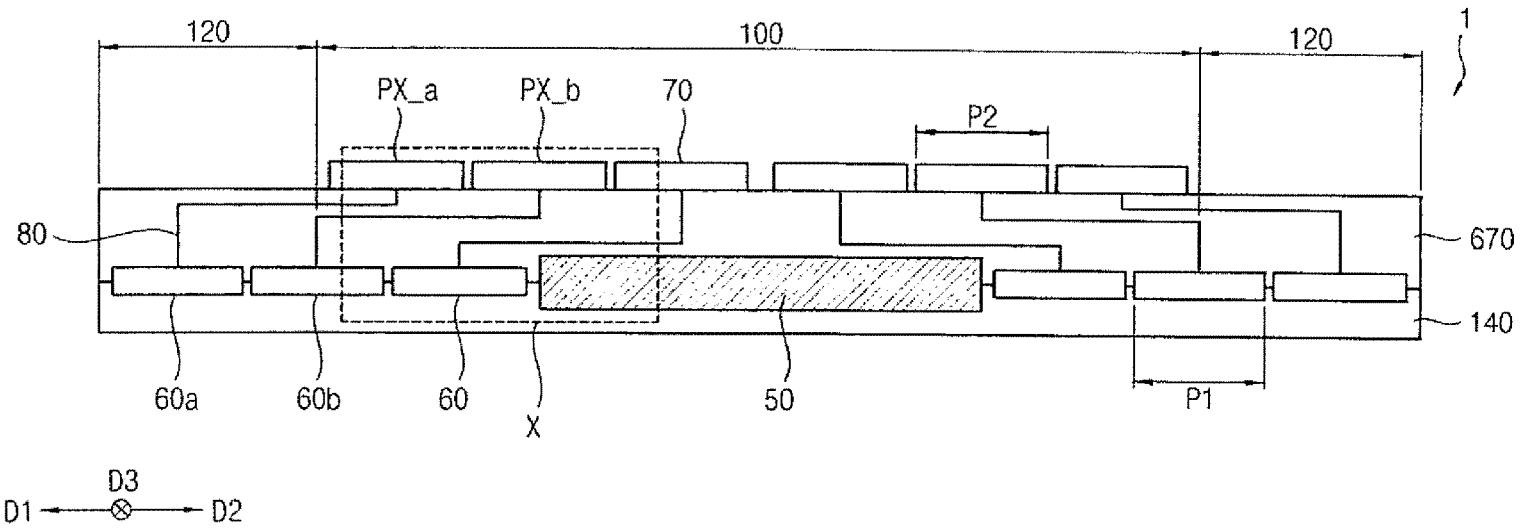
FIG. 2 is a cross-sectional view illustrating an example of the display device in FIG. 1 taken along a line I-I' in FIG. 1.
Figure 3:
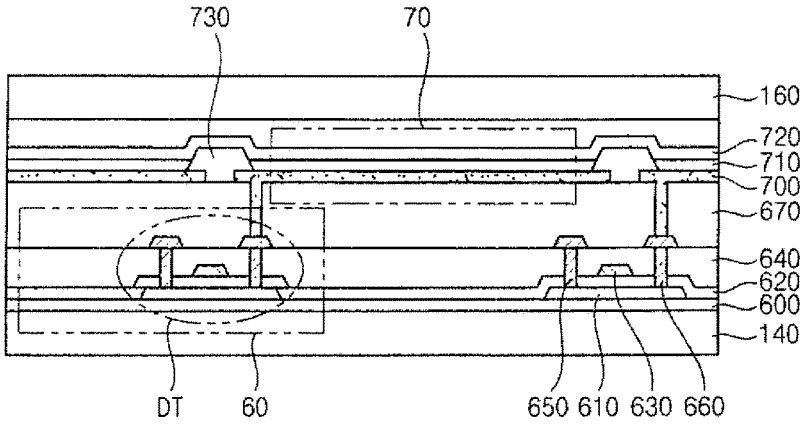
FIG. 3 is a cross-sectional view illustrating an example of an 'X' portion of the display device in FIG. 2.
Figure 4:
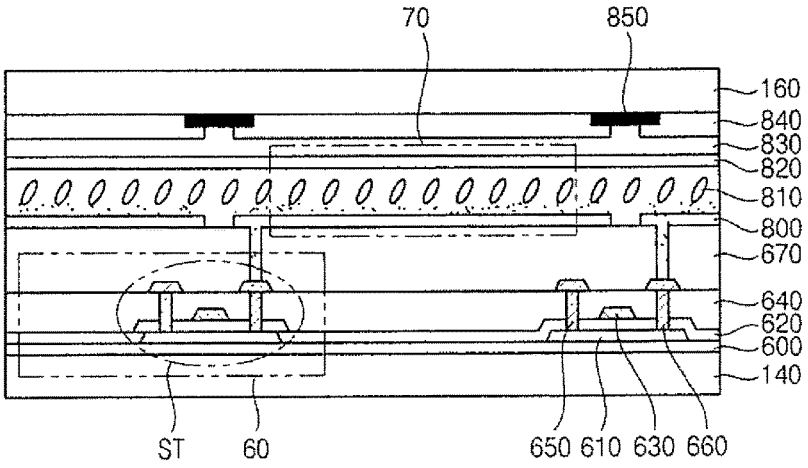
FIG. 4 is a cross-sectional view illustrating another example of an 'X' portion of the display device in FIG. 2.

FIG. 2 is a cross-sectional view illustrating an example of the display device in FIG. 1 taken along a line I-I' in FIG. 1. FIG. 3 is a cross-sectional view illustrating an example of an 'X' portion of the display device in FIG. 2. FIG. 4 is a cross-sectional view illustrating another example of an 'X' portion of the display device in FIG. 2.

Referring to FIG. 2, the plurality of pixels PX may include a plurality of pixel circuits 60, a plurality of display structures 70 and a plurality of connecting lines 80, respectively.

The pixel circuits 60 may apply current or voltage to the display structures 70. Each of the pixel circuits 60 may include at least one transistor and at least one capacitor. However, a driving transistor DT and a switching transistor ST which are electrically connected to the display structure 70 may be illustrated in FIGS. 3 and 4.

Referring to FIGS. 3 and 4, each of the driving transistor DT in FIG. 3 and the switching transistor ST in FIG. 4 may include an active pattern 610, a gate electrode 630, a source electrode 650 and a drain electrode 660. A buffer layer 600 may be disposed on a first substrate 140 (directions D1, D2, and D3 are parallel to the plane of the first substrate 140), and the active pattern 610 may be formed on the buffer layer 600. The gate electrode 630 may be insulated from the active pattern 610 by a gate insulation layer 620. Each of the source and the drain electrodes 650 and 660 may be formed on the active pattern 610 and the gate electrode 630. Each of the source and the drain electrodes 650 and 660 may be insulated from the gate electrode 630 by an insulation interlayer 640, and may be connected to the active pattern 610 through a contact hole that penetrates the gate insulation layer 620 and the insulation interlayer 640.

In example embodiments, the plurality of pixel circuits 60 and the driving circuit 50 may be disposed at the substantially same level (e.g., in a same layer or along a same plane). For example, transistors included in each of the plurality of pixel circuits 60 and transistors included in the driving circuit 50 may be disposed at the substantially same level. Here, the transistors included in each of the plurality of pixel circuits 60 and the transistors included in the driving circuit 50 may be concurrently (e.g., simultaneously) formed on the same layer. Therefore, the plurality of pixel circuits 60 and the driving circuit 50 may be not overlapped (or non-overlapping).

A planarization layer 670 may be disposed on a top of the plurality of pixel circuits 60. The planarization layer 670 may be formed as a stacked structure of inorganic layers and organic layers.

Each of the plurality of display structures 70 may be electrically connected to a corresponding pixel circuit 60 among the plurality of pixel circuits 60. For example, as illustrated in FIG. 2, the display structure 70 may be electrically connected to the pixel circuit 60 through the connecting line 80. The display structure 70 may emit light based on current or voltage applied from the pixel circuit 60. Therefore, the plurality of display structures 70 may define the display region 100 of the display panel 10.

Referring to FIG. 3, in example embodiments, the display structure 70 may be disposed on the driving transistor DT, and may include an anode 700 electrically connected to the driving transistor DT, an organic light-emitting layer 710 disposed on the anode 700, and a cathode 720 disposed on the organic light-emitting layer 710. Here, the display device 1 may be an organic light-emitting display device.

The anode 700 may be patterned by the pixel PX, and a pixel defining layer 730 may be formed around the anode 700. The pixel defining layer 730 may overlap an edge of the anode 700 and may expose a center (or central portion) of the anode 700.

The organic light-emitting layer 710 may be formed on the anode 700 to overlap the exposed center (or central portion) of the anode 700, and the cathode 720 may be substantially formed on the display region 100.

The plurality of pixels PX may emit light based on current applied from the driving transistors DT to display images on which the display structures 70 are disposed.

Referring to FIG. 4, in some example embodiments, the display structure 70 may be disposed on the switching transistor ST, and may include a pixel electrode 800 electrically connected to the switching transistor ST, a liquid crystal layer 810 disposed on the pixel electrode 800, and a common electrode 820 disposed on the liquid crystal layer 810. Here, the display device 1 may be a liquid crystal display device.

The pixel electrode 800 may be patterned by the pixel PX. The liquid crystal layer 810 and the common electrode 820 may be not patterned by the pixel PX and may be substantially formed on the display region 100.

A color filter 840 and a black matrix 850 may be formed on a second substrate 160 opposing the first substrate 140. The color filter 840 and the black matrix 850 may correspond to the pixel electrode 800 and define a light-emitting region. An overcoating layer 830 may be formed between the color filter 840 and the black matrix 850, and the common electrode 820.

The plurality of pixels PX may emit light based on voltage applied from the switching transistors ST to display images on which the display structures 70 are disposed.

Referring to FIG. 2 again, in example embodiments, each of the pixel circuits 60 may be disposed not to overlap its corresponding display structure 70 among the plurality of display structures 70. In other words, the pixel circuit 60 and the corresponding display structure 70 which are connected to each other through the connecting line 80 may be horizontally misaligned. For example, given a first pixel PX_a and a second PX_b that are adjacent to each other, the display structure 70 of the first pixel PX_a may not overlap a pixel circuit 60*a* of the first pixel PX_a, and may partially or substantially overlap a pixel circuit 60*b* of the second pixel PX_b. Therefore, although the driving circuit 50 may be disposed at the center portion (or central portion) of the display region 100 and may be disposed at the substantially same level (or layer or on a same plane, e.g., of the substrate 140) as the plurality of pixel circuits 60, the plurality of display structures 70 may be substantially disposed on a front surface of the display panel 10 and the images may be displayed on a substantial region of the front surface of the display panel 10.

In FIGS. 3 and 4, although the connecting line 80, illustrated in FIG. 2, is implemented by extending the anode 700 or the pixel electrode 800, the present inventive concept may be not limited thereto and may be modified in various example embodiments.

In example embodiments, as illustrated in FIG. 2, each of the pixel circuits 60 may be spaced apart by a distance (e.g., a predetermined distance) from the corresponding display structure 70 along a direction parallel to the plane of the substrate 140. For example, each of the pixel circuits 60 located in the first direction D1 from the driving circuit 50 among the pixel circuits 60 may be spaced apart by the distance along the first direction D1 from the corresponding display structure 70 that is connected through the connecting line 80. And, each of the pixel circuits 60 located along the second direction D2 from the driving circuit 50 among the pixel circuits 60 may be spaced apart by the distance in the second direction D2 from the corresponding display structure 70 that is connected through the connecting line 80.

In example embodiments, a width of each of the pixel circuits 60 may be substantially the same as a width of each of the display structures 70. For example, as illustrated in FIG. 2, when a width of the pixel circuit 60 in the first direction D1 is P1 and a width of the display structure 70 in the first direction D1 is P2, the width of the pixel circuit 60 P1 and the width of the display structure P2 along the first direction D1 may be substantially the same each other.

In example embodiments, at least one of the pixel circuits 60 may be at least partially disposed outside the display region 100. The pixel circuits 60 that are disposed at outermost areas of the display region 100 in the first direction D1 or in the second direction D2 may be partially or substantially disposed in the non-display region 120, because, in some embodiments, the pixel circuit 60 does not overlap its corresponding display structure 70. For example, as illustrated in FIG. 2, the pixel circuit 60*a* of the first pixel PX_a located at the outermost area of the display region 100 in the first direction D1 may be substantially disposed in the non-display region 120. And, the pixel circuit 60*b* of the second pixel PX_b adjacent to the first pixel PX_a in the second direction D2 may be partially disposed in the non-display region 120.

As described above, the display device 1 may include the driving circuit 50 disposed at the center portion of the display region 100, so that a size of the non-display region 120 may decrease and a dead space may decrease. Moreover, the pixel circuit 60 may not overlap the display structure 70, thus the images may be displayed on the substantially front surface of the display panel 10, although the driving circuit 50 is disposed at the center portion of the display region 100.

Figure 5:
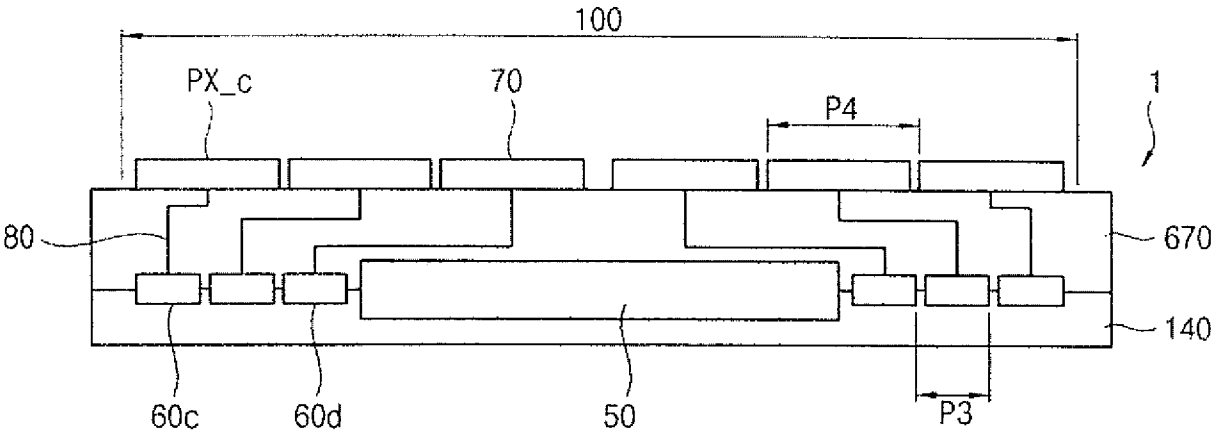
FIG. 5 is a cross-sectional view illustrating another example of the display device in FIG. 1 taken along a line I-I' in FIG. 1.

FIG. 5 is a cross-sectional view illustrating another example of the display device in FIG. 1 taken along a line I-I' in FIG. 1.

Referring to FIG. 1 and FIG. 5, the display device 1 may include the display panel 10, the plurality of pixels PX, the data driver 40 and the driving circuit 50, and each of the plurality of pixels PX may include a plurality of pixel circuits 60, a plurality of display structures 70 and a plurality of connecting lines 80. Detailed description on elements in FIG. 5 which are substantially the same as or similar to those illustrated with reference to FIGS. 2, 3, and 4 will not be repeated.

In example embodiments, a width of each of the pixel circuits 60 may be substantially narrower than a width of each of the display structures 70. For example, as illustrated in FIG. 5, when a width of the pixel circuit 60 in the first direction D1 is P3 and a width of the display structure 70 in the first direction D1 is P4, the P3 may be substantially less than the P4.

In example embodiments, a sum of widths of the plurality of pixel circuits 60 and a width of the driving circuit 50 may be substantially less than or equal to a sum of widths of the plurality of display structures 70. When the width of the pixel circuit 60 in the first direction D1 is substantially less than the width of the display structure 70 in the first direction D1, although some pixel circuits 60 (e.g., pixel circuit 60*d*) are not overlapped with its corresponding display structure 70, the pixel circuits 60 that are disposed at outermost areas of the display region 100 in the first direction D1 or in the second direction D2 may be substantially disposed in the display region 100. For example, as illustrated in FIG. 5, a pixel circuit 60*c* of a third pixel PX_c that is disposed at the outermost area of the display region 100 in the first direction D1 may be disposed in the display region 100. Here, the non-display region 120 of the display panel 10 may not substantially exist or may exist on a narrow edge of the display panel 10.

As mentioned above, according to example embodiments, because the widths of the pixel circuits 60 in the first direction D1 are substantially less than the widths of the display structures 70 along the first direction D1, although some pixel circuits 60 (e.g., pixel circuit 60*d*) are not overlapped with the display structure 70, the pixel circuits 60 may be disposed in the display region 100 (e.g., pixel circuit 60*c* is overlapped with its corresponding display structure PX_c). Therefore, the size of the non-display region 120 may decrease or the non-display region 120 may not substantially exist, so that the dead space may decrease.

Figure 6:
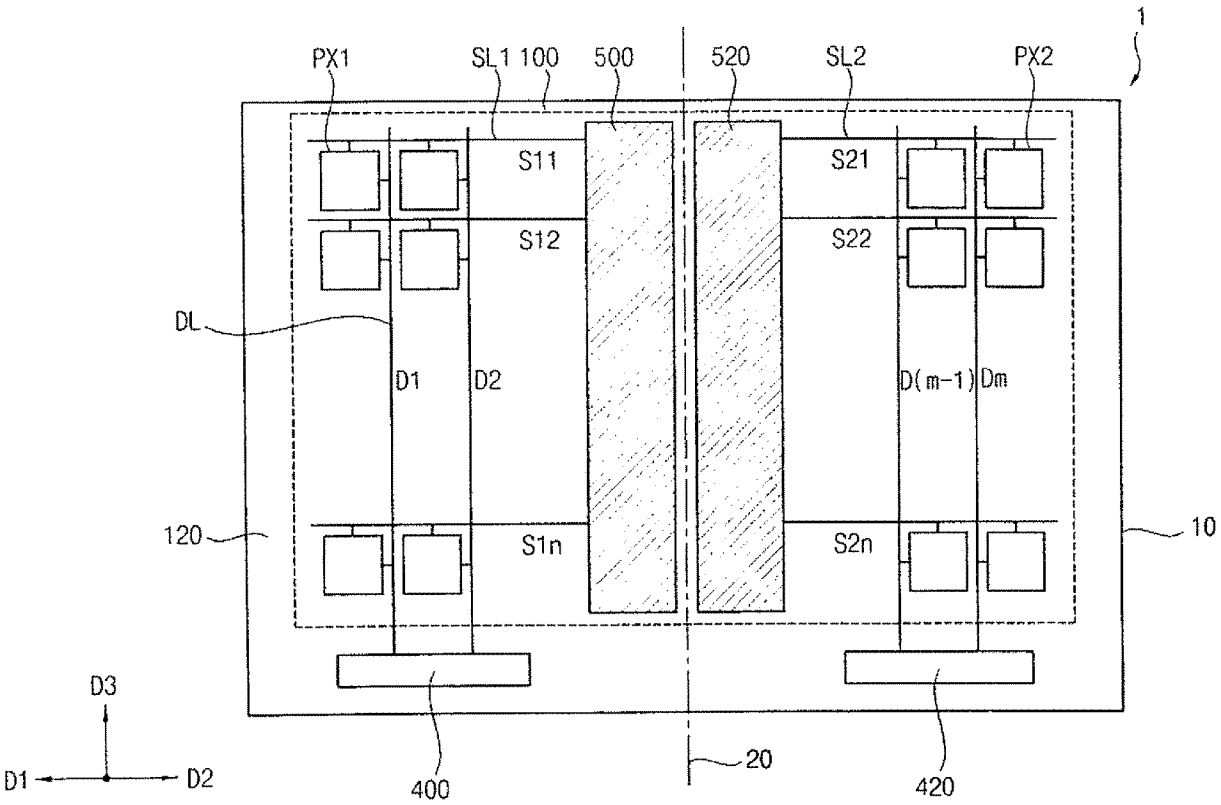
FIG. 6 is a plan view illustrating a display device in accordance with some example embodiments.

FIG. 6 is a plan view illustrating a display device in accordance with some example embodiments.

Referring to FIG. 6, a display device 1 may include a display panel 10, a plurality of pixels PX1 and PX2, a first data driver 400, a second data driver 420, a first driving circuit 500, and a second driving circuit 520. The plurality of pixels PX1 and PX2 may include (or be divided into) a first plurality of pixels PX1 and second plurality of pixels PX2. Detailed descriptions of elements in FIG. 6 which are substantially the same as or similar to those illustrated with reference to FIG. 1 will not be repeated.

A plurality of first driving lines SL1, a plurality of second driving lines SL2, a plurality of data lines DL, and the plurality of pixels PX1 and PX2 may be disposed in the display region 100. The plurality of first driving lines SL1 may extend in the first direction D1 from the first driving circuit 500 to transfer first driving signals S11 through S1*n*. The plurality of second driving lines SL2 may extend in the second direction D2 from the second driving circuit 520 to transfer second driving signals S21 through S2*n*. The plurality of data lines DL may extend in the third direction D3 from the first data driver 400 and the second data driver 420 to transfer data signals D1 through Dm. Each pixel of the first plurality of pixels PX1 may be connected to the first driving lines SL1 and the data line DL, and each pixel of the second plurality of pixels PX2 may be connected to the second driving lines SL2 and the data line DL.

The first plurality of pixels PX1 and the second plurality of pixels PX2 may be arranged on the display panel 10 in a substantially matrix structure. The first plurality of pixels PX1 may be located in the first direction D1 from a center-line 20 that passes by a center of the display panel 10 and extend along the third direction D3, and the second plurality of pixels PX2 may be located along the second direction D2 from the center-line 20 and extend along the third direction D3.

The first and the second data drivers 400 and 420 may be connected to the data lines DL. The first data driver 400 may generate and transfer the data signals D1 through D[m/2] to the first plurality of pixels PX1, and the second data driver 420 may generate and transfer the data signals D[(m/2)+1] through Dm to the second plurality of pixels PX2. The plurality of pixels PX1 and PX2 may emit light based on the data signals D1 through Dm transferred from the first and the second data drivers 400 and 420, respectively.

The first driving circuit 500 may be connected to the first driving lines SL1. The first driving circuit 500 may generate and transfer the first driving signals S11 through S1*n* to the first plurality of pixels PX1. The second driving circuit 520 may be connected to the second driving lines SL2. The second driving circuit 520 may generate and transfer the second driving signals S21 through S2*n* to the second plurality of pixels PX2. Transistors included in the first plurality of pixels PX1 may be switched based on the driving signals S11 through S1*n* transferred from the first driving circuit 500, and transistors included in the second plurality of pixels PX2 may be switched based on the driving signals S21 through S2*n* transferred from the second driving circuit 520.

The first driving circuit 500 and the second driving circuit 520 may be disposed at the center portion (or central portion) of the display region 100 which includes the center-line 20 of the display panel 10. For example, the first driving circuit 500 may be adjacent to the center-line 20 in the first direction D1 from the center-line 20, and the second driving circuit 520 may be adjacent to the center-line 20 in the second direction D2 from the center-line 20. Each of the first and the second driving circuits 500 and 520 may include a plurality of transistors.

In example embodiments, the first driving circuit 500 may include a first scan driver applying first scan signals to the first plurality of pixels PX1, and the second driving circuit 520 may include a second scan driver applying second scan signals to the second plurality of pixels PX2. Here, the first and the second driving lines SL1 and SL2 may correspond to (or include) scan lines. The first driving lines SL1 may extend in the first direction D1 from the first driving circuit 500 to be connected to switching transistors included in the first plurality of pixels PX1. The second driving lines SL2 may extend in the second direction D2 from the second driving circuit 520 to be connected to switching transistors included in the second plurality of pixels PX2.

In some example embodiments, the first driving circuit 500 may include a first light-emitting control driver applying first light-emitting control signals to the first plurality of pixels PX1, and the second driving circuit 520 may include a second light-emitting control driver applying second light-emitting control signals to the second plurality of pixels PX2. Here, the first and the second driving lines SL1 and SL2 may correspond to (or include) light-emitting control lines. The first driving lines SL1 may extend in the first direction D1 from the first driving circuit 500 to be connected to light-emitting control transistors included in the first plurality of pixels PX1. The second driving lines SL2 may extend in the second direction D2 from the second driving circuit 520 to be connected to light-emitting control transistors included in the second plurality of pixels PX2.

Figure 7:
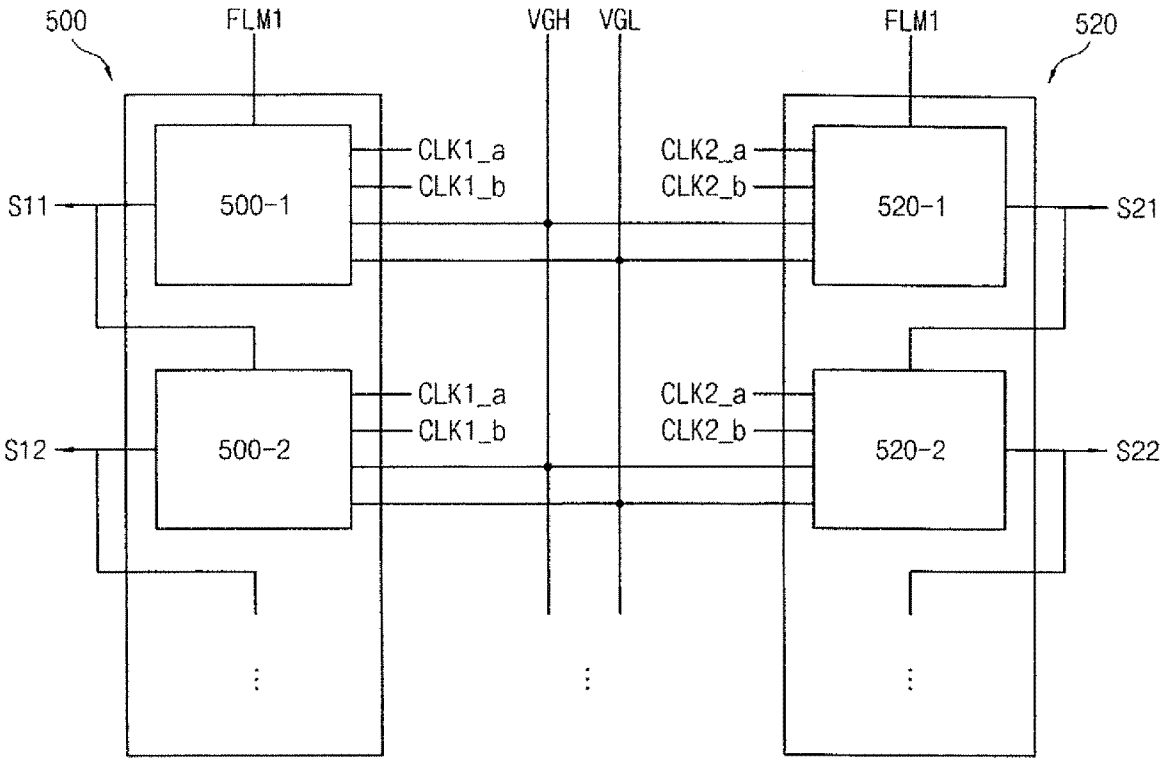
FIG. 7 is a block diagram illustrating a first driving circuit and a second driving circuit included in the display device in FIG. 6.

FIG. 7 is a block diagram illustrating a first driving circuit and a second driving circuit included in the display device in FIG. 6.

Referring to FIG. 7, each of the first driving circuit 500 and the second driving circuit 520 may include a plurality of driving blocks. A structure and driving of the second driving circuit 520 are substantially the same as or similar to a structure and driving of the first driving circuit 500, so that the structure and driving of the first driving circuit 500 will be mainly explained below.

The first driving circuit 500 may include a plurality of first driving blocks 500-1, 500-2, . . . which are dependently connected to each other and sequentially arranged. The first driving blocks 500-1, 500-2, . . . may generate and transfer first driving signals S11, S12, . . . to the plurality of first driving lines SL1 that respectively correspond to the first driving blocks 500-1, 500-2, . . . .

A power supply signal VG may be applied to the first driving circuit 500. For example, the power supply signal VG may include a first voltage VGL and a second voltage VGH having a higher level than the first voltage VGL. The power supply signal VG may supply power required to drive the first driving circuit 500.

In example embodiments, the first driving circuit 500 and the second driving circuit 520 may share power supply lines. For example, the first driving circuit 500 and the second driving circuit 520 may share a first power supply line applying the first voltage VGL and a second power supply line applying the second voltage VGH. Therefore, the number of the power supply lines applying the power supply signal VG may be reduced.

The first of the first driving blocks 500-1 may receive a first frame start signal FLM1, and each of the rest of the first driving blocks 500-2, . . . may receive an output signal of the preceding first driving block. For example, the second of the first driving blocks 500-2 may receive the first driving signal S11 of the preceding first driving block 500-1.

A first clock signal CLK1 may be applied to the first driving circuit 500, and a second clock signal CLK2 may be applied to the second driving circuit 520. The first clock signal CLK1 may correspond to a synchronization signal to sequentially apply the first driving signals S11 through S1*n* to the plurality of first driving lines SL1. The second clock signal CLK2 may correspond to a synchronization signal to sequentially apply the second driving signals S21 through S2*n* to the plurality of second driving lines SL2. For example, the first clock signal CLK1 may include a first sub-clock signal CLK1_*a* and a second sub-clock signal CLK1_*b* which have a half cycle phase difference to each other, and the second clock signal CLK2 may include a third sub-clock signal CLK2_*a* and a fourth sub-clock signal CLK2_*b* which have a half cycle phase difference to each other.

In example embodiments, a frequency of the first clock signal CLK1 and a frequency of the second clock signal CLK2 may be different from each other. For example, the frequency of the first clock signal CLK1 may be about 60 Hz, and the frequency of the second clock signal CLK2 may be less than 60 Hz. Here, a video may be implemented from the first plurality of pixels PX1 receiving first driving signals S11 through S1*n* from the first driving circuit 500. And, an image may be implemented from the second plurality of pixels PX2 receiving second driving signals S21 through S2*n* from the second driving circuit 520.

The first driving blocks 500-1, 500-2, . . . may output the first driving signals S11 through S1*n* generated based on input signals, respectively. The first driving blocks 500-1, 500-2, . . . may sequentially output the first driving signals S11 through S1*n*.

Figure 8:
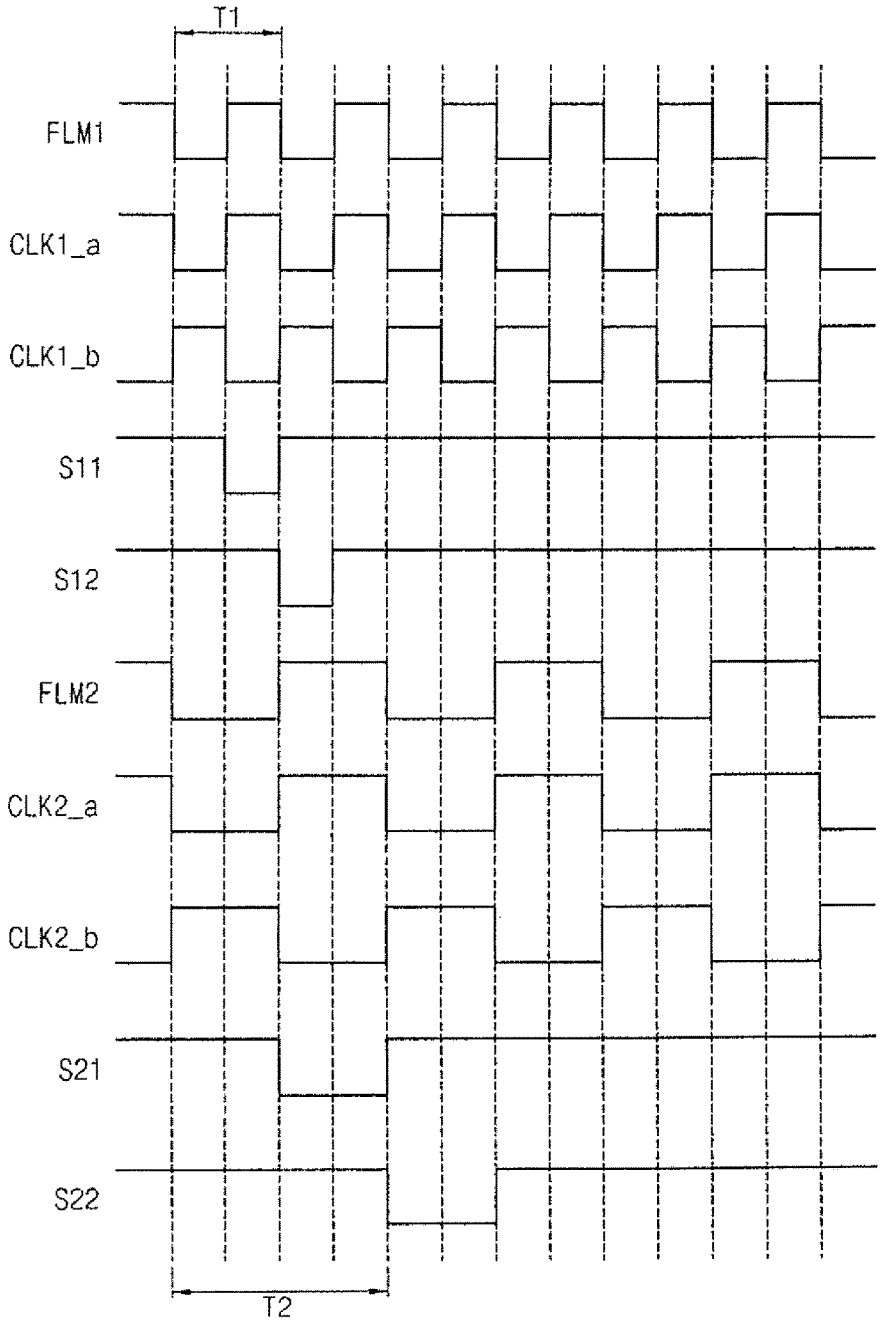
FIG. 8 is a timing diagram illustrating a first clock signal and a second clock signal respectively applied to the first driving circuit and the second driving circuit included in the display device in FIG. 6.

FIG. 8 is a timing diagram illustrating a first clock signal and a second clock signal respectively applied to the first driving circuit and the second driving circuit included in the display device in FIG. 6.

Referring to FIG. 8, in example embodiments, each of the first sub-clock signal CLK1_*a* and the second sub-clock signal CLK1_*b* included in the first clock signal CLK1 may be a periodic signal in which a low level voltage and a high level voltage may be alternately repeated during a first cycle T1. Each of the third sub-clock signal CLK2_*a* and the fourth sub-clock signal CLK2_*b* included in the second clock signal CLK2 may be a periodic signal in which a low level voltage and a high level voltage may be alternately repeated during a second cycle T2 that is substantially two times of the first cycle T1. In other words, a frequency of the second clock signal CLK2 may be about a half of a frequency of the first clock signal CLK1. Here, because the frequency of the first clock signal CLK1 is substantially two times of the frequency of the first clock signal CLK2, a frequency of the first driving signals S11 through S1*n* applied to the first plurality of pixels PX1 from the first driving circuit 500 may be substantially two times of a frequency of the second driving signals S21 through S2*n* applied to the second plurality of pixels PX2 from the second driving circuit 520. Therefore, the first plurality of pixels PX1 may be substantially driven two times faster than the second plurality of pixels PX2.

Although the frequency of the first clock signal CLK1 is substantially two times faster than the frequency of the second clock signal CLK2 in FIG. 8, embodiments of the present invention are not limited thereto and may be modified in various example embodiments.

In example embodiments, the first data driver 400 may receive the first clock signal CLK1, and the second data driver 420 may receive the second clock signal CLK2. The data signal and the driving signal applied to the same pixel may have the same frequency. Therefore, when the first driving circuit 500 for driving the first plurality of pixels PX1 receives the first clock signal CLK1, the first data driver 400 applying the data signals D1 through D[m/2] to the first plurality of pixels PX1 may receive the first clock signal CLK1. And, when the second driving circuit 520 for driving the second plurality of pixels PX2 receives the second clock signal CLK2, the second data driver 420 applying the data signals D[(m/2)+1] through Dm to the second plurality of pixels PX2 may receive the second clock signal CLK2.

As described above, the display device 1 may include the first driving circuit 500 and the second driving circuit 520 which are at the center portion (or central portion) of the display region 100. And, the first driving circuit 500 and the second driving circuit 520 may apply the driving signals having different frequencies from each other to the first plurality of pixels PX1 and the second plurality of pixels PX2, respectively. Thus, the first plurality of pixels PX1 and the second plurality of pixels PX2 may be independently driven, and the display region 100 may be divided to implement two images. Moreover, the length of the first driving lines SL1 and the second driving lines SL2 may decrease by about half, so that charging and discharging time for the first and the second driving lines SL1 and SL2 may be reduced.

Figure 9:
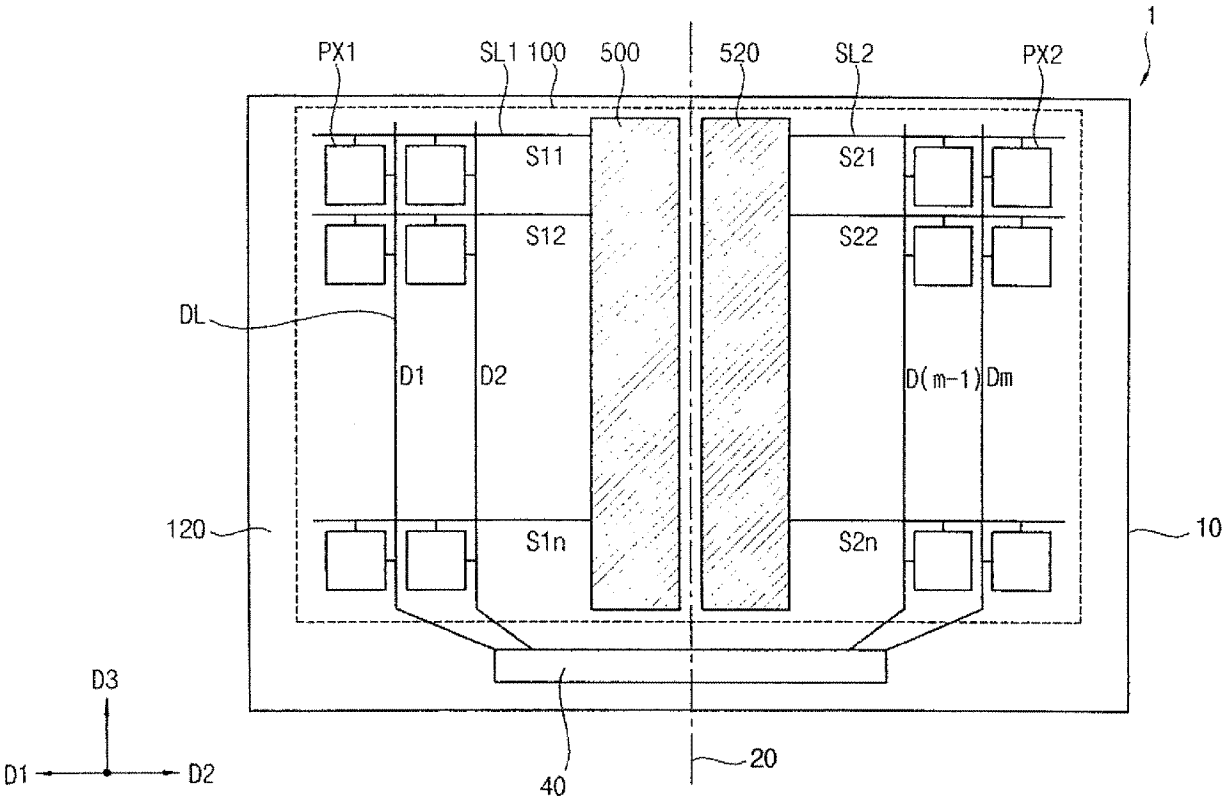
FIG. 9 is a plan view illustrating a display device in accordance with some example embodiments of the present invention.

FIG. 9 is a plan view illustrating a display device in accordance with some example embodiments of the present invention.

Referring to FIG. 9, a display device 1 may include a display panel 10, a plurality of pixels PX1 and PX2, a data driver 40, a first driving circuit 500 and a second driving circuit 520. The plurality of pixels PX1 and PX2 may include (or be divided into) a first plurality of pixels PX1 and a second plurality of pixels PX2. Detailed description on elements in FIG. 9 which are substantially the same as or similar to those illustrated with reference to FIG. 6 will not be repeated.

The data driver 40 may be connected to the data lines DL. The data driver 40 may generate and transfer the data signals D1 through Dm to the first plurality of pixels PX1 and the second plurality of pixels PX2. The plurality of pixels PX1 and PX2 may emit light based on the data signals D1 through Dm transferred from the data driver 40, respectively.

Figure 10:
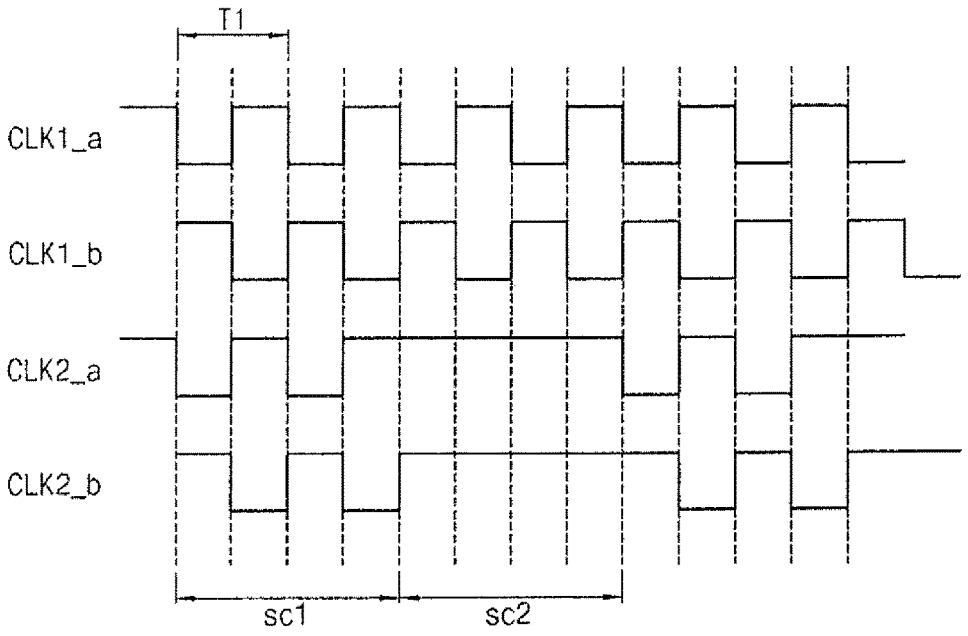
FIG. 10 is a timing diagram illustrating a first clock signal and a second clock signal respectively applied to a first driving circuit and a second driving circuit included in the display device in FIG. 9.

FIG. 10 is a timing diagram illustrating a first clock signal and a second clock signal respectively applied to a first driving circuit and a second driving circuit included in the display device in FIG. 9.

In example embodiments, the second clock signal CLK2 may periodically have an activation period sc1 during which the second clock signal CLK2 periodically toggles and a deactivation period sc2 during which the second clock signal CLK2 is deactivated, and a frequency of the second clock signal CLK2 during the activation period sc1 may be substantially the same as a frequency of the first clock signal CLK1. Each of the first sub-clock signal CLK1_*a* and the second sub-clock signal CLK1_*b* included in the first clock signal CLK1 may be a periodic signal in which a low level voltage and a high level voltage are alternately repeated during a first cycle T1. Each of the third sub-clock signal CLK2_*a* and the fourth sub-clock signal CLK2_*b* included in the second clock signal CLK2 may be a periodic signal in which a low level voltage and a high level voltage are alternately repeated during the first cycle T1 during the activation period sc1. For example, as illustrated in FIG. 10, the second clock signal CLK2 may be substantially the same as the first clock signal CLK1 during the activation period sc1. The third sub-clock signal CLK2_*a* and the fourth sub-clock signal CLK2_*b* included in the second clock signal CLK2 may maintain one of the low level voltage and the high level voltage during the deactivation period sc2. For example, as illustrated in FIG. 10, the third sub-clock signal CLK2_*a* and the fourth sub-clock signal CLK2_*b* may maintain the high level voltage during the deactivation period sc2. Therefore, the second driving circuit 520 receiving the second clock signal CLK2 may apply the second driving signals S21 through S2*n* that have substantially the same frequency as the first driving signals S11 through S1*n* during the activation period sc1, however, may not apply the second driving signals S21 through S2*n* during the deactivation period sc2. The activation period sc1 and the deactivation period sc2 may be repeated periodically.

In example embodiments, the data driver 40 may receive the first clock signal CLK1. Because the frequency of the first clock signal CLK1 and the frequency of the second clock signal CLK2 may be substantially the same each other during the activation period sc1, the data driver 40 applying the data signals D[(m/2)+1] through Dm to the second plurality of pixels PX2 may receive the first clock signal CLK1 instead of the second clock signal CLK2. Moreover, because the second driving signals S21 through S2*n* may be not applied (e.g., are not applied) during the deactivation period sc2, the second plurality of pixels PX2 may be not driven even though the data signals D[(m/2)+1] through Dm are applied to the second plurality of pixels PX2. Here, for example, the data driver 40 may apply the data signals D[(m/2)+1] through Dm with a gray level (or gray scale level) corresponding to black color to the second plurality of pixels PX2. Therefore, even though the second clock signal CLK2 is applied to the second driving circuit 520 that drives the second plurality of pixels PX2, the first clock signal CLK1 may be applied to the data driver 40 that applies the data signals D[(m/2)+1] through Dm to the second plurality of pixels PX2. When the first driving circuit 500 and the second driving circuit 520 respectively receive the first clock signal CLK1 and the second clock signal CLK2 which have different frequencies from each other, the data driver 40 may receive the first clock signal CLK1. Thus, the first plurality of pixels PX1 and the second plurality of pixels PX2 may receive the data signals D1 through Dm by using one data driver 40.

Although example embodiments of the display devices have been described with reference to the figures, those skilled in the art will readily appreciate that many modifications are possible in the example embodiments without materially departing from the novel teachings and advantages of the present inventive concept.

Aspects of embodiments of the present invention may be applied to any electronic device that includes a display device. For example, the embodiments of the present invention may be applied to display devices for computers, notebooks, cellular phones, smart phones, smart pads, portable media players (PMPs), personal digital assistances (PDAs), MP3 players, digital cameras, video camcorders, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of aspects of embodiments of the present invention. Accordingly, all such modifications are intended to be included within the scope of embodiments of the present invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and equivalents thereof.

What is claimed is:

1. A display device, comprising:

a plurality of pixels respectively comprising a plurality of pixel circuits, each of the pixel circuits having at least one transistor, and a plurality of display structures connected to the plurality of pixel circuits, the plurality of display structures defining a display region of the display device; and a driving circuit configured to drive the plurality of pixels, the driving circuit being at a center portion of the display region, wherein a sum of widths of the plurality of pixel circuits and a width of the driving circuit is less than or equal to a sum of widths of the plurality of display structures.

2. The display device of claim 1, wherein each of the plurality of pixel circuits is connected to a corresponding display structure among the plurality of display structures, and does not overlap the corresponding display structure.

3. The display device of claim 2, wherein each of the plurality of pixel circuits is spaced apart by a distance from the corresponding display structure.

4. The display device of claim 1, wherein the plurality of pixel circuits and the driving circuit are disposed at a same level.

5. The display device of claim 1, wherein a width of each of the plurality of pixel circuits is a same as a width of each of the plurality of display structures.

6. The display device of claim 5, wherein at least one of the plurality of pixel circuits is at least partially outside the display region.

7. The display device of claim 1, wherein a width of each of the plurality of pixel circuits is narrower than a width of each of the plurality of display structures.

8. The display device of claim 1, wherein the display structure comprises:

an anode on the transistor and electrically connected to the transistor;

an organic light-emitting layer on the anode; and a cathode on the organic light-emitting layer.

9. The display device of claim 1, wherein the display structure comprises:

a pixel electrode on the transistor and electrically connected to the transistor;

a liquid crystal layer on the pixel electrode; and a common electrode on the liquid crystal layer.

10. The display device of claim 1, wherein the driving circuit comprises a scan driver configured to supply scan signals to the plurality of pixels.

11. The display device of claim 1, wherein the driving circuit comprises a light-emitting control driver configured to supply light-emitting control signals to the plurality of pixels.

12. The display device of claim 1, wherein at least one of the display structures overlaps the driving circuit at the center portion of the display region.

13. A display device, comprising:

a plurality of pixels respectively comprising a plurality of pixel circuits, each of the pixel circuits having at least one transistor, and a plurality of display structures connected to the plurality of pixel circuits, the plurality of display structures defining a display region of the display device, the plurality of pixels comprising:

a first plurality of pixels disposed in a first direction from a center-line of the display region; and a second plurality of pixels disposed in a second direction from the center-line, the second direction being opposite to the first direction;

a first driving circuit configured to drive the first plurality of pixels; and a second driving circuit configured to drive the second plurality of pixels, wherein the first driving circuit and the second driving circuits are at a center portion of the display region that includes the center-line, wherein the first driving circuit is configured to receive a first clock signal, and the second driving circuit is configured to receive a second clock signal, wherein the second clock signal periodically has an activation period in which the second clock signal periodically toggles and a deactivation period in which the second clock signal is deactivated, and wherein a frequency of the second clock signal in the activation period is a same as a frequency of the first clock signal.

14. The display device of claim 13, wherein the first driving circuit and the second driving circuit share a power supply line.

15. The display device of claim 13, wherein the first driving circuit is configured to receive a first clock signal, and the second driving circuit is configured to receive a second clock signal, and wherein a frequency of the first clock signal is different from a frequency of the second clock signal.

16. The display device of claim 15, further comprising:

a first data driver connected to the first plurality of pixels; and a second data driver connected to the second plurality of pixels, wherein the first data driver is configured to receive the first clock signal, and the second data driver is configured to receive the second clock signal.

17. The display device of claim 13, further comprising:

a data driver connected to the first plurality of pixels and the second plurality of pixels, wherein the data driver is configured to receive the first clock signal.

18. The display device of claim 13, wherein the first driving circuit includes a first scan driver configured to supply first scan signals to the first plurality of pixels, and the second driving circuit includes a second scan driver configured to supply second scan signals to the second plurality of pixels.

19. The display device of claim 13, wherein the first driving circuit includes a first light-emitting control driver configured to supply first light-emitting control signals to the first ones of the plurality of pixels, and the second driving circuit includes a second light-emitting control driver configured to supply second light-emitting control signals to the second ones of the plurality of pixels.

20. The display device of claim 13, wherein at least one of the display structures overlaps the first driving circuit at the center portion of the display region.

* * * * *